United States Patent [19]

Ferrarelli

[11] Patent Number: 4,474,491

[45] Date of Patent: Oct. 2, 1984

[54] CAN STACKER

[76] Inventor: John Ferrarelli, P.O. Box 241, Indiana, Pa. 15701

[21] Appl. No.: 331,660

[22] Filed: Dec. 17, 1981

[51] Int. Cl.[3] ..... F16B 7/04

[52] U.S. Cl. ..... 403/305; 211/183; 211/188; 108/111; 446/127

[58] Field of Search ..... 403/305; 46/29, 30; 211/182, 183, 188

[56] References Cited

U.S. PATENT DOCUMENTS

| | | | |
|---|---|---|---|
| 2,972,833 | 2/1961 | Grutta | 46/30 X |
| 3,640,018 | 2/1972 | Light | 403/305 X |
| 3,751,082 | 8/1973 | Somerville | 403/305 X |
| 4,170,082 | 10/1979 | Freedman | 46/29 |
| 4,261,470 | 4/1981 | Dolan | 211/182 X |

FOREIGN PATENT DOCUMENTS

| | | | |
|---|---|---|---|
| 2743356 | 4/1979 | Fed. Rep. of Germany | 403/381 |

*Primary Examiner*—Thomas F. Callaghan
*Attorney, Agent, or Firm*—William J. Ruano

[57] ABSTRACT

A can stacker comprising a square piece or interlocking element of moulded plastic material with circular recesses on both sides to conform to the diameter of the ends of empty beverage cans to be stacked, which cans constitute throw away items. The four edges of the plastic piece are shaped like a square dove-tail, with two adjoining sides male and the other two adjoining sides female so that may interlock horizontally with other interlocking elements in parallel vertical stacks as well as interlocking the ends of vertically stacked cans. Such cans may be used for building numerous useful items, such as coffee tables, bookcases, room divider, etc.

1 Claim, 4 Drawing Figures

CAN STACKER

This invention relates to a can stacker and, more particularly, to a specially shaped plastic interlocking molded piece to interlock cans while in vertically stacked, parallel relationship, for building various useful pieces of furniture and other useful or ornamental items.

An outstanding disadvantage of presently known constructions for making useful items is that the parts such as wood, metal, plastic, etc. are costly and add considerably to the total cost of the assembly.

Another disadvantage is that such parts are time consuming and expensive to piece together for building desirable items, particularly those for use in a household.

An object of my invention is to overcome the above disadvantages of conventional modes of construction.

A more specific object of my invention is to provide a novel, inexpensive and relatively simple interlocking piece for joining together empty, vertically stacked cans to serve as legs of tables, desks, or as supporting parts of other structures.

Other objects and advantages will become more apparent from a study of the following description taken with the accompanying drawing wherein:

FIG. 3 is a fragmentary elevational view of one type of construction embodying legs or supports for shelving or the like.

Figure 1:
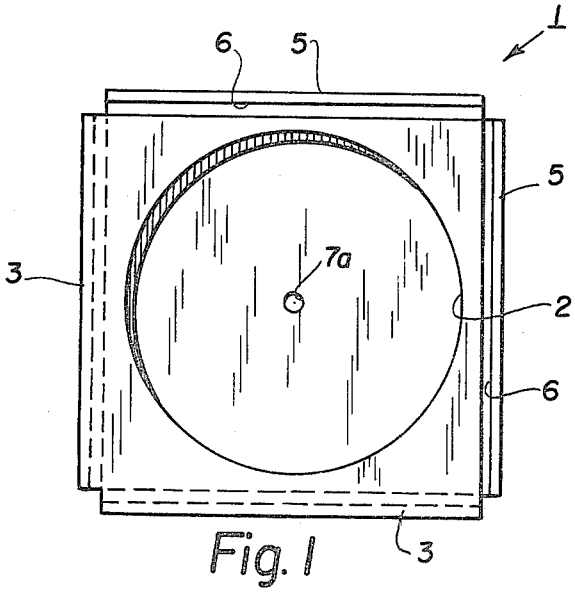
FIG. 1 is a plan view of an interlocking element for interlocking vertically stacked empty cans both vertically and horizontally and embodying the present invention.
Figure 2:
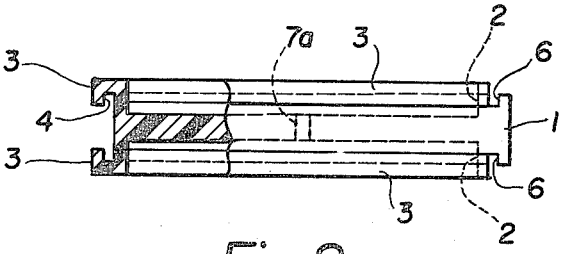
FIG. 2 is side view thereof partly cutaway in vertical cross-section.

Referring more particularly to FIGS. 1 & 2 of the drawing, numeral 1 generally denotes an interlocking element embodying the present invention for interlocking the end portions of a pair of vertically stacked empty cans. Such element comprises a square-piece 3 of any suitable material, preferably plastic molded material, having a thickness of about 1" with about ⅜" deep circular recesses 2 on both sides to conform with the outer diameter of the end portions of an empty beverage can. A hole 7 of about 3/16" is provided in the center thereof for fastening screws.

As shown more clearly in FIG. 2 the edges are shaped to a somewhat square dove-tail profile with two adjoining sides male and the other two adjoining sides female on diagonally opposite sides of the interlocking element so as to enable vertical interlocking of the empty cans and horizontal interlocking of the interlocking elements. The above dimensions are for illustration only and may be varied in some applications.

In operation, the end of one empty can is placed in the upper well portion 2 of the interlocking element 1 and the other is placed in the lower well portion thereof. Then by virtue of the fact that the edges 3—3 at the left are somewhat of square, dovetailed shape, they constitute the female elements that are engageable by the projecting male elements 6—6 on the diagonally opposite side to enable two or more vertically stacked cans to be laterally and horizontally interconnected.

Figure 3:
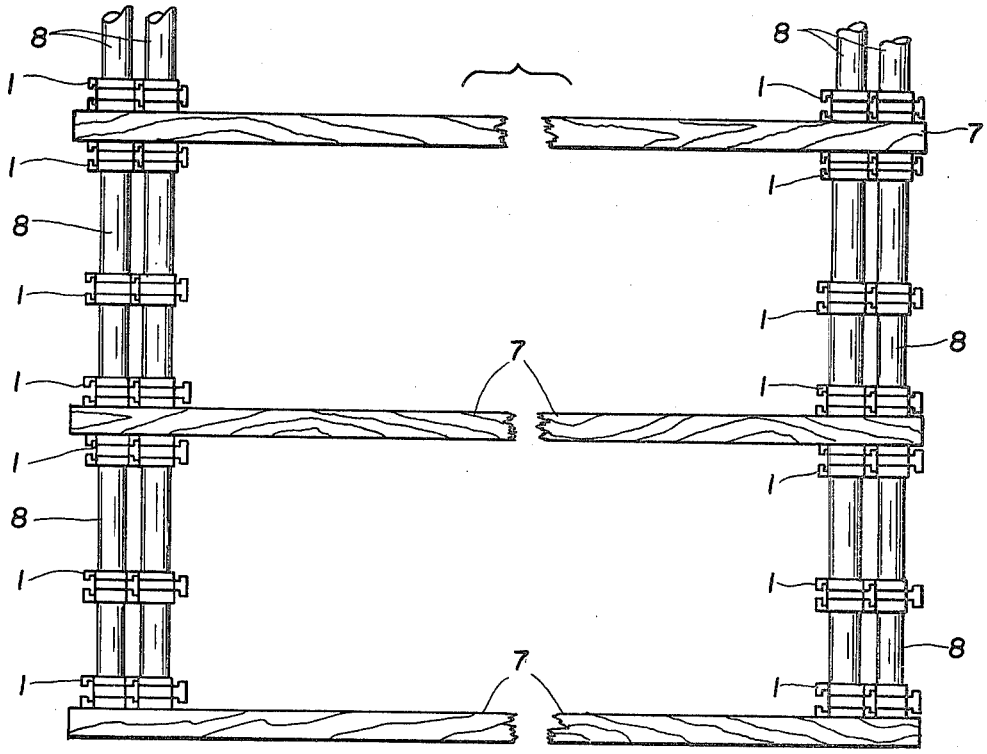
Figure 4:
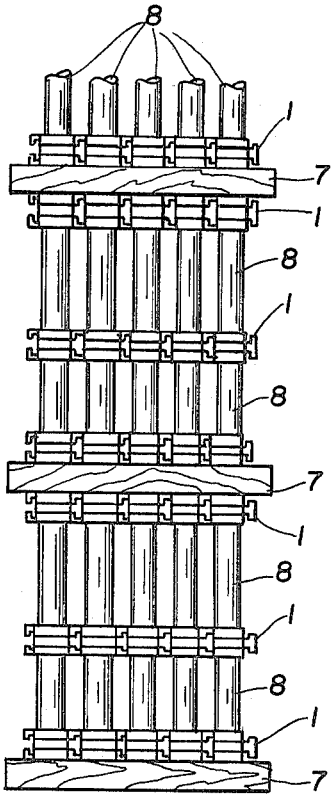
FIG. 4 is a side view of construction shown in FIG. 3 serving as an example of structures that can be readily assembled by the present invention.

FIG. 3 is a fragmentary portion of a bookcase and FIG. 4 is an end view of the bookcase shown in FIG. 3 and illustrate how a multiplicity of empty cans may be interconnected in vertically stacked, parallel relationship.

The interconnecting element of FIG. 2 may be made of any suitable material, such as plastic material, hard rubber, wood, heavy cardboard etc.

Holes 7 are preferably formed in the center of the circular recesses to facilitate introduction of fastening screws or bolts to secure the square pieces to the top of bottom surfaces of shelving or to the base or floor for rigidity of the assembly.

While a bookcase has been illustrated as an example or what may be constructed by the present invention, other examples may be coffee tables, room dividers or other items including vertical supports forming legs, pillars or the like.

Thus it will be seen that I have provided a highly efficient interlocking element to enable easy and quick assembly of large numbers of empty cans in parallel rows of vertically stacked cans.

While I have illustrated and described a single specific embodiment of my invention, it will be understood that this is by way of illustration only and that various changes and modifications may be contemplated in my invention within the scope of the following claims.

I claim:

1. Construction assembly of empty cylindrical cans comprising interlocking elements, each of substantially square outline with upper and lower cylindrical well portions of substantially the same diameter as that of the ends of the cans, which they snugly receive, two adjoining rectangular sides of said elements constituting female elements of substantially square dove-tailed shape, and the other two adjoining rectangular sides constituting male elements, correspondingly shaped to fit therein, for horizontally interlocking one element with another element in another vertically stacked row of cans in close horizontal proximity so as to form a pillar assembly, and a small center hole extending through each of said well portions for inserting of fastening screws or bolts to secure the bottom and top interlocking elements of said vertically stacked row of cans to the top and bottom surfaces respectively of shelving for vertical and horizontal rigidity of the entire assembly.

* * * * *